US006090230A

United States Patent [19]

Okamura et al.

[11] Patent Number: 6,090,230

[45] Date of Patent: Jul. 18, 2000

[54] METHOD OF COOLING A STEEL PIPE

[75] Inventors: Kazuo Okamura, Nishinomiya; Naruhito Shouji, Tonosho-machi; Michiharu Hariki, Omigawa-machi; Kunio Kondo, Sanda, all of Japan

[73] Assignee: Sumitomo Metal Industries, Ltd., Osaka, Japan

[21] Appl. No.: 08/866,100

[22] Filed: May 30, 1997

[30] Foreign Application Priority Data

Jun. 5, 1996 [JP] Japan ..... 8-142488
Jul. 5, 1996 [JP] Japan ..... 8-176160

[51] Int. Cl.[7] ..... C21D 9/08

[52] U.S. Cl. ..... 148/590; 148/592

[58] Field of Search ..... 148/590, 592; 226/111, 113, 117

[56] References Cited

U.S. PATENT DOCUMENTS 4,834,344 5/1989 Hoetzl et al. ..... 266/90

FOREIGN PATENT DOCUMENTS 58-113323 7/1983 Japan .
60-197821 10/1985 Japan .
63-149320 6/1988 Japan .
2-236257 9/1990 Japan .
2-247360 10/1990 Japan .
3-82711 4/1991 Japan .
4-224656 8/1992 Japan .
7-310126 11/1995 Japan .

*Primary Examiner*—Sikyin Ip
*Attorney, Agent, or Firm*—Burns, Doane, Swecker & Mathis, LLP

[57] ABSTRACT

A method of cooling a martensitic steel pipe by cooling the inner and outer surface substantially equally while rotating the pipe around the axis, wherein the cooling rate is 8° C./s or higher. The inner surface is preferably cooled by passing water without completely filling the inside of pipe. The maximum cooling rate at the both surfaces is 35° C./s or lower for a martensitic stainless steel pipe. The 2-step cooling method of a martensitic stainless steel pipe, comprising the 1st air cooling where the pipe is cooled from 30° C. lower than Ms(martensitic transformation start temp.) to the average of Ms and Mf(martensitic transformation finish temp.) and 2nd intensive water cooling where the the pipe is cooled down below Mf. The 3-step cooling method comprising 1st intensive cooling where the pipe is cooled from Ms+400° C. to Ms, 2nd mild cooling where the pipe is cooled from Ms to the average of Ms and Mf, and 3rd intensive cooling to the Mf.

14 Claims, 10 Drawing Sheets

AMOUNT OF WATER: 15m$^3$/h
WETTING ANGLE: 160°

AMOUNT OF WATER: 25m$^3$/h
WETTING ANGLE: 180°

AMOUNT OF WATER: 35m$^3$/h
WETTING ANGLE: 220°

METHOD OF COOLING A STEEL PIPE

FIELD OF THE INVENTION

The present invention concerns a method of cooling a steel pipe and, more specifically, it relates to a method of cooling a martensitic stainless steel pipe having an excellent wet corrosion resistance to carbon dioxide and corrosion resistance to sulfide stress cracking without causing quench cracking.

BACKGROUND OF THE INVENTION

Martensitic stainless steel pipes have been used considerably in recent years in various application uses that require strength and corrosion resistance, particularly, as oil countries tubular goods for petroleum and natural gas wells. With the expansion of applied field, corrosive environments to which steel materials for petroleum and natural gas production are exposed have become more severe. For instance, pressure in the working environments has increased along with the increase of well depth and, in addition, wells have been set increasingly in hostile environments, for example, containing wet carbon dioxide, hydrogen sulfide and chlorine ions at high concentrations. In view of the above, the demand for higher strength has increased and corrosion and embrittlement of tubular goods for oil and gas wells by corrosive ingredients have resulted in a significant problem. Consequently, requirement for higher strength tubular goods with an excellent corrosion resistance has been increased. In the subsequent explanation, "excellent corrosion resistance" means resistance both to "corrosion" and "embrittlement" caused by corrosive ingredients. The embrittlement caused by corrosive ingredient means, for example, sulfide stress corrosion cracking, due to hydrogen sulfide. In the succeeding explanation, "martensitic stainless steel" means both steels in which a martensitic phase after cooling and a transformation constitute a main phase, and steels in which the austenite phase constitutes a main phase at the elevated temperature.

The martensitic stainless steel pipe does not have sufficient resistance to corrosion by sulfide stress corrosion cracking but has excellent resistance to corrosion by wet carbon dioxide. Accordingly, they have been used generally in such environments, that contain wet carbon dioxide at a relatively low temperature. As a typical example, the oil countries tubular goods made of martensitic stainless steels of L80 grade defined by API (American Petroleum Institute) can be mentioned. That is the oil countries tubular goods made of martensitic stainless steels comprising, on the weight percent basis, C: 0.15–0.22%, Si: below 1.00%, Mn: 0.25–1.00%, Cr: 12.0–14.0%, P: below 0.020%, S: below 0.010%, Ni: below 0.50% and Cu: below 0.25%. The L80 grade oil countries tubular goods are generally used mainly in such an environment as containing wet carbon dioxide at a relatively low temperature under a partial pressure of hydrogen sulfide of 0.002 atm or less.

The martensitic stainless steel pipes, including the L80 grade pipes defined by API, generally serve for use after applying hardening and tempering. However, since the start temperature of the martensite transformation of the martensitic stainless steel (it is hereinafter referred to as a Ms point and the finish temperature of the martensitic transformation is referred to as a Mf point) is about 300° C. Such Ms point of martensitic stainless steels is lower compared with that of low alloy steels and the their hardenability is large, so they are highly sensitive to quench cracking. Especially, in the hardening of steel pipes, differing from the case of sheet or rod materials, since high stresses are distributed in a complicated manner, quench cracking is often caused by usual water quenching. Therefore, it was necessary for the hardening of the martensitic stainless steel pipe to adopt a cooling method with a low cooling rate such as intensive air cooling or blast air cooling in order to avoid quench cracking. However, although the above-mentioned method can prevent quench cracking, it involves a problem of poor productivity and the deterioration of mechanical properties and corrosion resistance occur due to the low cooling rate of such method. In the succeeding explanations, "cooling" means "cooling for quenching or hardening", unless otherwise specified.

Generally, the following factors are known for the effects of the cooling rate on the corrosion resistance and the other properties of the martensitic stainless steel pipe.

(a) The sensitivity to sulfide stress corrosion cracking increases as the tensile strength is higher and does not depend on the yield strength. This means that improved strength can be attained without degrading the corrosion resistance by raising the yield strength without increasing the tensile strength of oil countries tubular goods designed for the stress based on the yield strength. Accordingly, in the martensitic stainless steel pipe, increasing the yield ratio(yield strength/tensile strength) is used as an index for judging the performance. It is judged more advantageous as the yield ratio is higher.

(b) Austenite tends to remain in the martensitic stainless steel even after cooling. The residual austenite is decomposed by tempering into ferrite and carbide to lower the yield ratio and the corrosion resistance.

(c) For reducing the residual austenite, the cooling rate has to be increased significantly. It must be much greater than the cooling rate achieved by the air cooling process which is at present adopted. However, blast air cooling or oil quench can not provide a cooling rate, capable of reducing the residual austenite to a level causing no problems.

A method has been proposed for blowing cooling water by a nozzle to the outer surface of a steel pipe while rotating the pipe and supplying cooling water uniformly over the entire surface of the steel pipe, thereby avoiding uneven cooling (Japanese Patent Laid-Open Hei 3-82711). This method enables cooling to occur at the cooling rate from 1 to 20° C./s, thus more effectively suppressing the residual austenite as compared with existent air cooling. However, the worry of causing quench cracking has not yet been overcome.

Furthermore, as a method of cooling a steel pipe at a high efficiency, there has been a method proposed for supplying cooling water from the end of a steel pipe into the inside, while rotating the pipe and, at the same time, flowing down a laminar cooling water to the outer surface of the steel pipe thereby cooling the inner and the outer surfaces of the steel pipe (Japanese Patent Laid-Open Hei 7-310126). This method can conduct intensive cooling at a cooling rate of 40° C./s or higher and attain efficient cooling. However, the quench cracking has not yet been overcome completely.

Furthermore, an invention relating to a method of cooling a martensitic stainless steel with a specified chemical composition under a specific cooling condition has also been proposed (Japanese Patent Laid-Open Sho 63-149320, Japanese Patent Publication Hei 1-14290, Japanese Patent Laid-Open Hei 2-236257, 2-247360 and 4-224656).

Among them, the Japanese Patent Publication Hei 1-14290 discloses that the sensitivity to stress corrosion cracking is lowered by applying a solution pretreatment to oil countries tubular goods and then cooling at a cooling rate of 1 to 20° C./s. However, quench cracking caused upon rapid cooling is not mentioned at all.

Furthermore, in Japanese Patent Laid-Open Hei 2-236257, Hei 2-247360, Hei 4-224656 and the like, there are provided steels so-called "super 13 Cr" with the C content lower than usual, as well as a manufacturing method for solving both the problems of the corrosion resistance to sulfide stress corrosion cracking and quench cracking. However, since the contents of expensive alloying elements have to be increased in both of the methods, there is a problem of dramatic increase in cost.

SUMMARY OF THE INVENTION

An object of the present invention is to provide a method of cooling a steel pipe not causing quench cracking, particularly, a method of cooling a martensitic stainless steel pipe having excellent corrosion resistance in oil countries environments without causing quench cracking.

The basic method of cooling a steel pipe according to the present invention resides in the following cooling method.

A method of cooling a steel pipe while rotating a steel pipe around the axis of the pipe axis while making the cooling rate in an entire temperature region at the inner surface of the steel pipe substantially equal to or lower than that at the outer surface of the steel pipe, wherein the cooling rate at the minimum cooling rate position is 8° C./s or higher in a temperature region from "the central temperature between the Ms point and the Mf point" to the Mf point.

The cooling method for making the cooling rate substantially equal between the inner surface and the outer surface of a steel pipe includes a method of cooling the outer surface of a rotating pipe with a laminar flow of water, and passing water for the inner surface while not completely filling the inside of the pipe with a wetting angle no more than 220°. Furthermore, as the cooling method for making the cooling rate at the inner surface not substantially higher than that at the outer surface in the entire temperature region, including, for example, a method of cooling the outer surface of a rotating pipe by laminar flow water or spray water with a restricted amount of water while cooling the inner surface with air. In the succeeding description, "intensive cooling" means cooling the outer surface with a sufficient amount of water, for example, cooling with laminar flow water or with spray water with a sufficient amount of water, while "mild cooling" may sometimes be used for cooling the outer surface with a restricted amount of water, for example, by cooling with spray water with a restricted amount of water. For cooling the inner surface, the term "intensive cooling" or "mild cooling" is not used, even in a case of water cooling.

In all of the methods for the present inventions specified in this application, the steel pipe is cooled substantially in a horizontal state while being rotated around a pipe axis.

The following cooling method (1) is based on the above-mentioned basic method for applying intensive cooling for the outer surface in the entire temperature region while making the cooling rate at the inner surface substantially equal to that at the outer surface thereby preventing quench cracking while suppressing residual austenite.

(1) A method for cooling a steel pipe, while rotating the pipe around the axis of the pipe, flowing down or spraying cooling water on to the outer surface of a steel pipe, passing cooling water to the inside of the pipe such that the cooling water has a wetting angle of no more than 220°, making the cooling rate at the inner surface substantially equal to that at the outer surface and controlling the maximum cooling rate at the inner and the outer surfaces of the steel pipe being 35° C./s or lower thereby cooling the martensitic stainless steel pipe (hereinafter referred to as the "invention [1]").

The following methods (2) and (3) are also based on the basic method but they are more specific than that defined in the basic method, of applying air cooling in an entire temperature region on the inner surface and applying a combination of air cooling, mild cooling and intensive cooling for the outer surface, thereby suppressing the residual austenite and preventing quench cracking (refer to FIG. 3 and FIG. 4 shown later). The cooling rate at the inner surface is made lower than that at the outer surface in the entire temperature region.

(2) A method of cooling a martensitic stainless steel pipe comprising the first cooling of applying air cooling till the temperature at the outer surface of the steel pipe reaches a temperature region from "Ms point −30° C." to "the central temperature between Ms point and Mf point" and the second cooling of successively applying intensive cooling for the outer surface of the pipe at a cooling rate at the inner surface of 8° C./s or higher till the temperature at the outer surface reaches a temperature region lower than Mf point while rotating the steel pipe around the axis of the pipe (hereinafter referred to as "invention [2]").

(3) A method for cooling a martensitic stainless steel pipe comprising the first cooling by applying intensive cooling to the outer surface till the temperature at the outer surface of the steel pipe reaches a temperature region from "Ms point +400° C." to Ms point, the second cooling of successively applying mild cooling to the outer surface till the temperature at the outer surface reaches a temperature region from Ms point to "the central temperature between Ms point and Mf point", with an average heat transfer coefficient in the second cooling on the outer surface less than ½ of that upon completion of the first cooling and the third cooling by applying intensive cooling to the outer surface of the pipe with a cooling rate at the inner surface of 8° C./s or higher till the temperature at the outer surface is lowered below the Mf point, while rotating the steel pipe around the axis of the pipe (hereinafter referred to as the "invention [3]").

The present invention relates to the martensitic stainless steel pipe but it may be applicable to a medium carbon steel pipe or the like suffering from a problem of quench cracking.

The position of the steel pipe at which the cooling rate is at a minimum is at the central position for the thickness of the steel pipe in the case of the method of invention [1], whereas the position is at the inner surface of the steel pipe in the case of the invention [2] and the invention [3].

The cooling rate of 8° C./s or higher at the position of the steel pipe for the minimum cooling rate means a cooling rate in the temperature region from "the central temperature between the Ms point and the Mf point" to the Mf point.

For invention [1], the following factors are important. When Water flows, cooling on the inner surface of the steel pipe, cooling is conducted in a state in which the cooling water does not completely fill the steel pipe, for example, cooling is conducted at a wetting angle of less than 180° on the inner surface, as described later.

Generally, since the water cooling of the steel material is conducted by heat transfer during contact mainly between the steel material and water, the area of contact between the, surface of the steel material and water per unit time gives an effect on the heat removing amount, that is, the cooling rate. In a state in which the cooling water is completely filled in the steel pipe, since cooling water is always in contact with the inner surface even when the steel pipe is rotated, the cooling rate at the inner surface greatly exceeds that at the outer surface even when the outer surface is cooled, for example, by laminar flow water of a sufficient amount.

The maximum cooling rate of 35° C./s or lower in invention [1] means the maximum cooling rate though out the entire cooling process. In a case of water cooling the steel pipe, since the cooling rate during nucleate boiling (low temperature region) is higher than the cooling rate during film boiling (high temperature region), the maximum cooling rate of 35° C./s or lower can be obtained though out the cooling process by making the cooling rate during nucleate boiling 35° C./s or lower. For intensive cooling on the outer surface of the steel pipe, the maximum cooling rate can easily be controlled to 35° C./s or lower by reducing the amount of cooling water to be flown down or blown on the outer surface of the steel pipe.

The following factors are important for invention [3].

The heat transfer coefficient means a value obtained by dividing the heat flux per unit time and per unit area though the outer surface of a steel pipe ($J/s-m^2=W/m^2$) during cooling with the difference of temperature between the outer surface and the coolant. Accordingly, the heat transfer coefficient depends on, for example, the cooling apparatus, the state of the cooling medium (water or oil) and the outer surface of the steel pipe and the temperature and it generally tends to be increased as the temperature is lower. The average heat transfer coefficient means an average value of a heat transfer coefficient for the objective temperature region, that is, from the start temperature to the stop temperature in the second cooling of invention [3]. The heat transfer coefficient upon completion of the first cooling means the average heat transfer coefficient which is averaged around the completion temperature in the first cooling. The average heat transfer coefficient of the third cooling is also the averaged value around the start temperature of the third cooling. The heat transfer coefficient or the average heat transfer coefficient can be controlled by the amount of cooling water per unit area and unit time.

In invention [1], the temperature or the cooling rate at the inner and the outer surfaces of the steel pipe means the temperature or the cooling rate, as shown in FIG. 11 to be described later, at positions 3 mm inward from each of the surfaces. The thermocouples are attached on the bottom in the hole drilled in the pipe. Whereas,in invention [2] and [3], the temperature and the cooling rate at the outer or the inner surfaces means the temperature and the cooling rate on the outer surface or on the inner surface, such as the temperature and the cooling rate measured by the thermocouple attached on the outer surface or on the inner surface.

BRIEF DESCRIPTION OF THE ACCOMPANYING DRAWINGS

FIG. 1A is a cross sectional view illustrating an example of a cooling apparatus suitable to conduction of invention [1];

FIG. 1B is a cross sectional view illustrating an example of a cooling apparatus suitable to conduction of invention [2] and invention [3]. In the figures are shown a steel pipe 1, a nozzle 3 for supplying cooling water for outer surface, a rotational support roll 4, inner surface cooling water 5, outer surface cooling water 6, a shutter 7 and a lower spray nozzle 8.

FIG. 2 is a vertical cross sectional view illustrating an example of a cooling apparatus suitable for conduction of invention [1]. In the figure is shown a nozzle 2 for supplying inner surface cooling water.

FIG. 3 is a schematic graph showing the temperature progress at the outer surface of a steel pipe upon applying the method of invention [2]. In the figure, are shown temperature 11 "Ms point −30° C.", temperature 12 "the central temperature between Ms point and Mf point", first cooling temperature 13 in invention [2], second cooling temperature 14 in invention [2], and first cooling stop temperature and second cooling start temperature 15 in invention [2];

FIG. 4 is a schematic view showing the temperature progress at the outer surface of a steel pipe upon applying the method of invention [3]. In the figure, are shown temperature 16 "Ms point +400° C.", Ms point 17, first cooling 18 in invention [3], second cooling 19 in invention [3], third cooling 20 in the invention [3], first cooling stop temperature and second cooling start temperature 21 in invention [3] and second cooling stop temperature and third cooling start temperature 22 in invention [3];

FIG. 5 is a graph illustrating an example of a cooling curve actually measured at the inner surface and the outer surface of a steel pipe upon applying the method of invention [3];

FIG. 6 is a graph showing the effect of the second cooling start temperature on the circumferential residual stress on the outer surface upon applying the method of invention [2]. In the figure, are shown difference ΔT between the second cooling start temperature and the Ms point. The second cooling start temperature is lower than the Ms point when the ΔT is positive while the start temperature is higher than the Ms point when the ΔT is negative.

FIG. 7 is a graph showing the effect of the third cooling start temperature on the circumferential residual stress on the outer surface upon applying the method of invention [3]. Numerical values in the parenthesis on the abscissa represents ΔT.

FIG. 8 is a graph illustrating a relationship among the average heat transfer coefficient Hb in second cooling, the average heat transfer coefficient Hc in third cooling and third cooling starting temperature to make the residual stress 200 MPa upon applying the method of invention [3]. In the figure, numerical values each attached to each of flexed lines in the figure represents the third cooling start temperature.

FIGS. 14 A–D are a schematic views illustrating the flow of cooling water in invention [1]. The wetting angle on the inner surface is an angle measured in a state where the steel pipe is not rotated.

Figure 15:
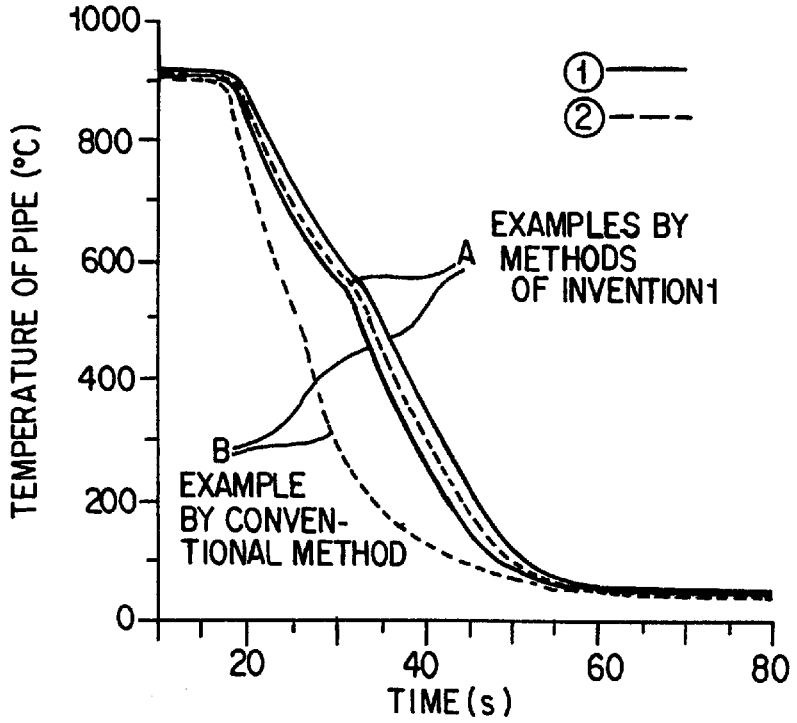

FIG. 15 is a graph illustrating cooling curves for the steel pipe in Example 1. The curve A shows a result for the example by the present invention and the curve B shows a result of an example by a conventional method.

Figure 16B:
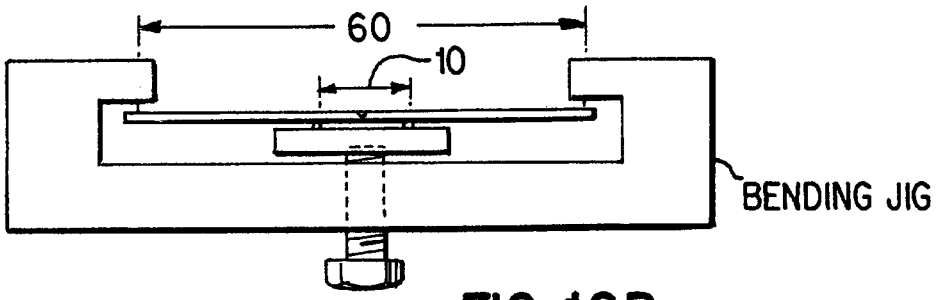
Figure 16A:
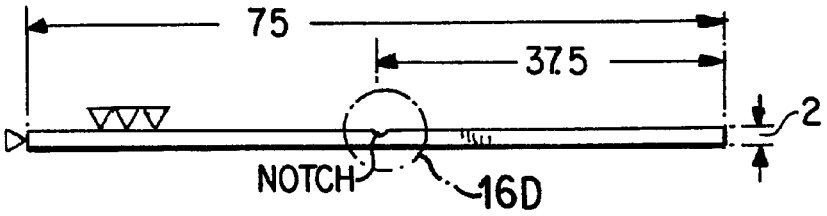
Figure 16C:
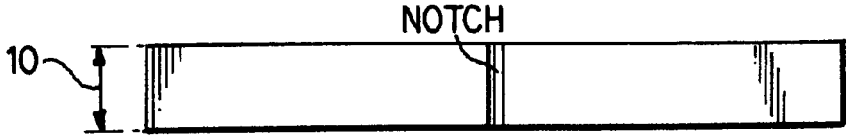
Figure 16D:
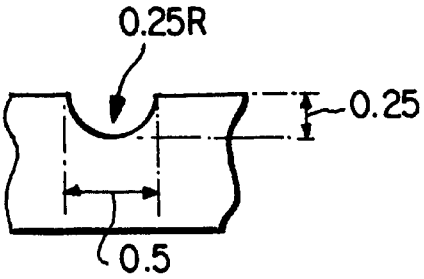

FIG. 16A shows a cross-sectional diagram of a 4-point bending test piece with notch, FIG. 16B is a cross-sectional diagram illustrating a state of attaching the test piece to a 4-point bending test jig, FIG. 16C shows a top view of the test piece shown in FIG. 16A and FIG. 16D shows an enlarged view of circled portion 16D in FIG. 16.

DESCRIPTION OF PREFERRED EMBODIMENTS

The present invention will be explained by way of preferred embodiments with reference to the drawings.

1. Cooling Apparatus

Figure 1A:
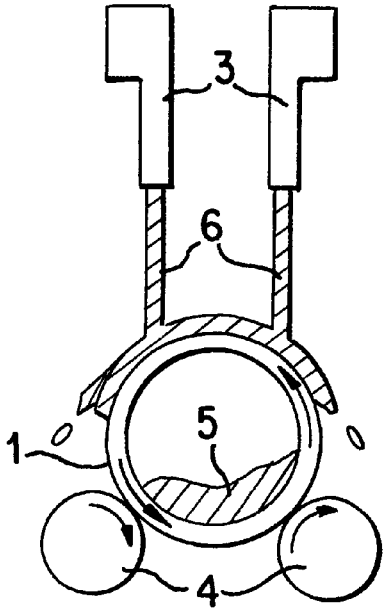
Figure 1B:
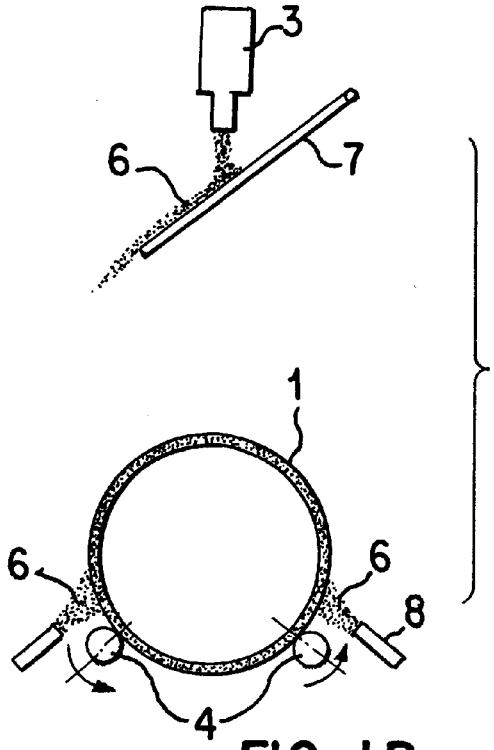

FIG. 1A and FIG. 1B are cross sectional views illustrating a cooling apparatus suitable for conduction of the present inventions. FIG. 1A is an example of a cooling apparatus suitable for conduction of invention [1] while FIG. 1B is an example of a cooling apparatus suitable for conduction of invention [2] and invention [3].

In any of the inventions, steel pipe 1 is rotated on rotational support rolls 4. In invention [1] and, inner surface cooling water 5 from an inner surface cooling nozzle 2 is supplied such that the wetting angle on the inner surface is usually 180° or less, as shown in FIGS. 14A to 15D to be described later and cools the inner surface of the rotating steel pipe at a cooling rate substantially equal to that at the outer surface. For the intensive cooling at the outer surface, laminar outer surface cooling water 6 is flown down, for example, from the outer surface cooling nozzles 3 arranged in two rows at the upper portion of the steel pipe 1, to cool the outer surface of the steel pipe 1. For the intensive cooling apparatus for the outer surface, while a double slit laminar cooling is exemplified in FIG. 1A, a single line slit laminar cooling may be used as shown in FIG. 1B. In the same manner, double slit laminar water may be used for cooling the outer surface in invention [2] and invention [3].

Figure 2:
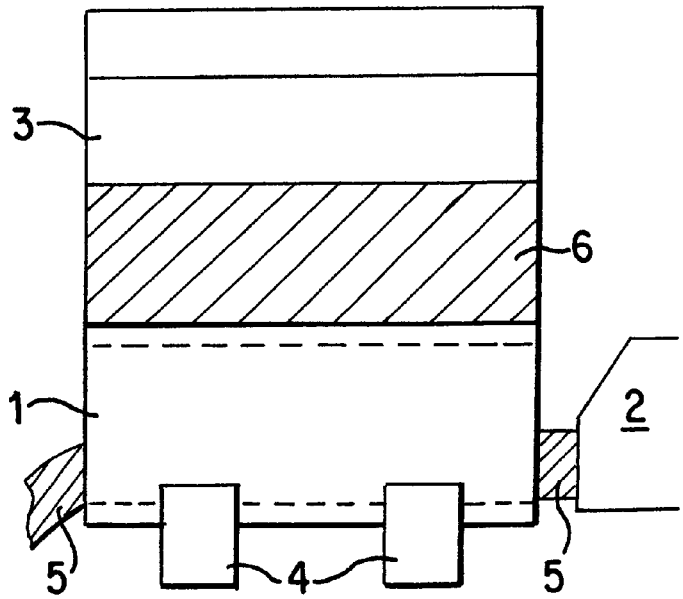

FIG. 2 is a vertical cross sectional view illustrating an arrangement of nozzles for inner surface cooling in the method of invention [1]. A nozzle 2 for supplying inner surface cooling water having a mechanism capable of controlling the flow rate of cooling water in accordance with the size of a steel pipe and cooling conditions is organized such that cooling water does not directly hit the pipe edge, for preventing overcooling at the pipe edge,which tends to cause quench cracking.

In the method of invention [2] and invention [3], the inner surface of the steel pipe is air cooled for the entire temperature region. The outer surface is cooled preferably, for example, by air cooling in the first cooling of invention [2], while using a slit laminar cooling apparatus illustrated in FIG. 1B in second cooling for intensive cooling. In invention [3], it is preferred to apply, for example, slit laminar cooling in the first cooling for intensive cooling, while interrupting the slit laminar flow by a shutter 7 and cooling using only cooling water 6, from a lower spray nozzle 8, having smaller cooling performance in the second cooling for mild cooling. In the third cooling, cooling is preferably applied by removing the shutter 7 and using the slit laminar coding again. In this case, the lower spray may be interrupted or not interrupted. Since the third cooling is intensive cooling, the lower spray is not interrupted but usually used in combination with the laminar flow water. FIG. 1B illustrates the state of the second cooling as mild cooling of invention [3].

The apparatus for intensive cooling on the outer surface of the steel pipe is not restricted only to the laminar flow apparatus as illustrated in FIG. 1A and FIG. 1B, but it may be such an apparatus for simultaneously spraying water through a series of circumferential nozzles placed specifically along the horizontal length of the pipe, so that a sufficient amount of water can be ensured per unit area and unit time.

In a case of using a laminar flow cooling apparatus for the intensive cooling of the outer surface, or passing water for cooling the inner surface, a rotational apparatus capable of rotating the steel pipe at a rotational speed of 40 rpm or greater, preferably, 50 rpm or greater is preferably used for reducing the temperature unevenness in the circumferential direction of the pipe.

2. Cooling Rate

In the method of invention [1], the maximum cooling rate at the position at the inner and the outer surfaces of a martensitic stainless steel pipe is made to 35° C./s or below and the cooling rate at or lower the Ms point at the central thickness position of the steel pipe (minimum cooling rate) is made to 8° C./s or higher. This can be attained by controlling the flow rate of the cooling water 5 for the inside of the pipe and controlling the conditions for cooling the outer surface. If the maximum cooling rate exceeds 35° C./s, the martensitic stainless steel pipe suffers from quench cracking unless the carbon content is restricted to a low level. Furthermore, if the cooling rate at the central position of the thickness is lower than 8° C./s, residual austenite remains in martensite to deteriorate corrosion resistance and mechanical property.

The lower limit for the cooling rate at the inner and the outer surfaces of the steel pipe is to be determined by the condition of making the cooling rate 8° C./s or higher at the central position of the thickness of the steel pipe. Furthermore, the upper limit for the cooling rate at the central position of the thickness of the steel pipe is also determined depending on the condition of making the cooling rate 35° C./s or lower at the inner and the outer surfaces of the steel pipe.

Description will then be made about the cooling rate in invention [2] and invention [3].

Figure 3:
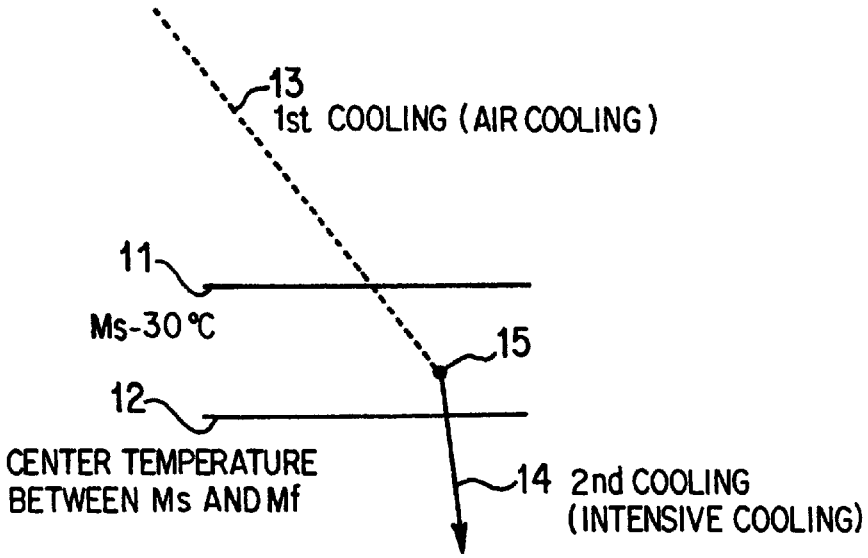
Figure 4:
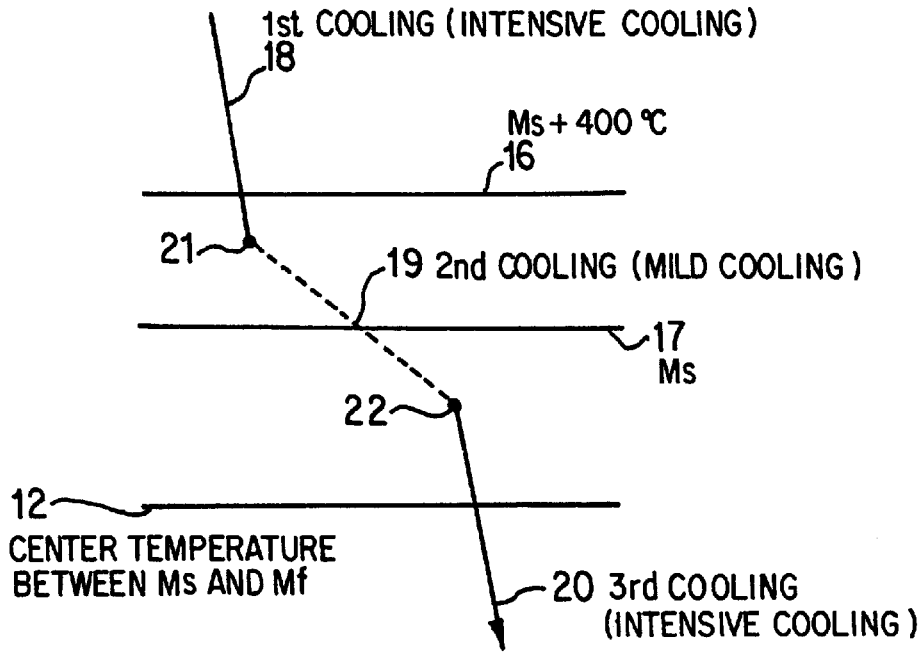

FIG. 3 and FIG. 4 are, respectively, schematic views for the progress of the outer surface temperature by the method of invention [2] and invention [3]. In both of the figures, "the central temperature" means "a temperature between the Ms point and the Mf point", that is (Ms point+Mf point)/2. The cooling rate in a temperature region from the central temperature to the Mf point gives an intensive effect on the amount of residual austenite. If the cooling rate in the temperature region is lower than 8° C./s, the residual austenite increases as described above to decrease the corrosion resistance and the mechanical property, so that it has to be at 8° C./s or higher at the inner surface of the steel pipe at which the cooling rate is minimum in the cooling method of invention [2] and invention [3].

Although there is no particular restrictions for the upper limit of the cooling rate at the inner surface of the steel pipe, it is to be restricted, from the condition that the coolant for cooling from the outer side is water.

The Ms point and the Mf point may be determined from the calculated values based on the chemical composition of the steel or from the actual measured transformation curves, thus the determined Ms point or Mf point has no substantial difference as compared with the actual value and causes no problem in practicing the present invention. The Ms point for the martensitic stainless steel as the object of the present invention is from 200° C. to 300° C., while the Mf point is within a range from room temperature to 150° C.

Figure 5:
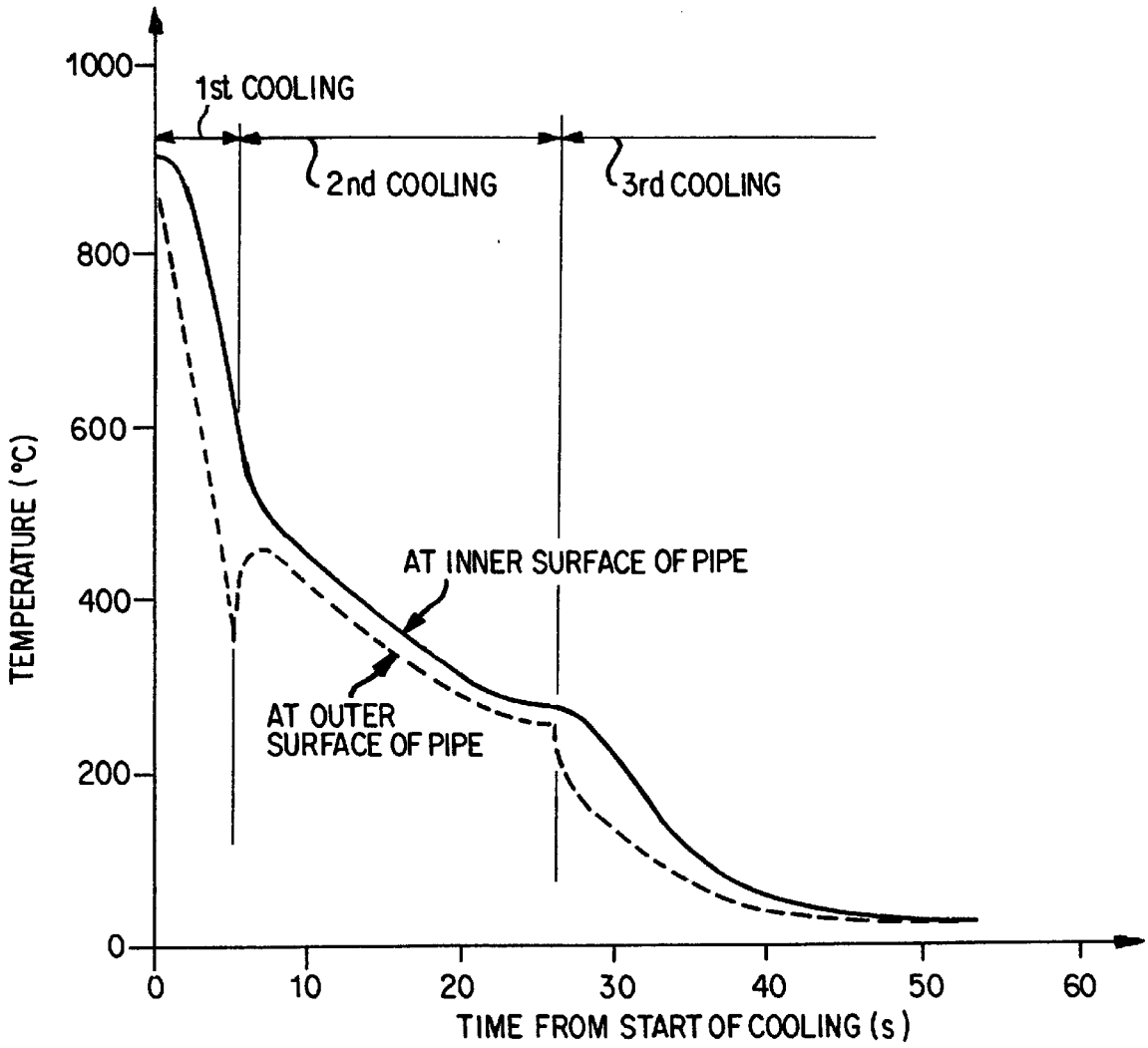

FIG. 5 is a graph illustrating a cooling curve actually measured at the inner surface and the outer surface of the steel pipe upon applying the cooling method of invention [5].

3. Relationship between the Cooling Method and the Residual Stress.

The cooling method for the steel pipe of invention [1] comprises passing cooling water into a steel pipe with a wetting angle no more than 220° while rotating the steel pipe around the pipe axis. According to this method, the area of contact between the inner surface of the steel pipe and water per unit time has to be reduced to attain the same extent of the cooling rate on both surfaces. Since the above-mentioned methods cool both the inner and the outer surfaces simultaneously, uniform cooling can be attained in the direction of the thickness of the steel pipe. However, even if the cooling rate is made almost equal between the inner and the outer surfaces, the residual stress is increased if the cooling rate exceeds 35° C./s, the cooling rate is controlled to 35° C./s or lower.

Furthermore, the inner surface wetting angle in the cross sectional surface of the pipe is preferably within about 90° to 180°. The wetting angle in the cross sectional surface of the pipe is an angle for the region of the inner surface of the pipe covered with the cooling water as viewed from the axial center of the pipe. Since the inner surface wetting angle is determined by the inner diameter of the steel pipe and the flow rate of the water, it is desirable that the relationship between them may be determined prior to the enforcement. When the inner surface wetting angle is within the range described above, it is possible to attain the almost equal cooling rate on both surfaces and stable water passage can also be attained.

By controlling the flow rate and the inner surface wetting angle of the inner surface cooling water 5 in accordance with the size of the tooling pipe 1 and the cooling conditions, and also controlling the cooling conditions for the outer surface in accordance therewith, a desired cooling which is uniform for the direction of the thickness can be attained. The cooling procedures of invention [2] and invention [3] are almost the same as the methods of invention [1] described above except for applying the outer surface cooling divisionally in two steps or three steps. Descriptions will be shown to illustrate the relationship between the cooling method and the residual stress in each of invention [2] and invention [3].

In the cooling method of invention [2], the stop temperature 15 of the first cooling (air cooling) is lower than "Ms point−30° C." and higher than the central temperature 12.

Figure 6:
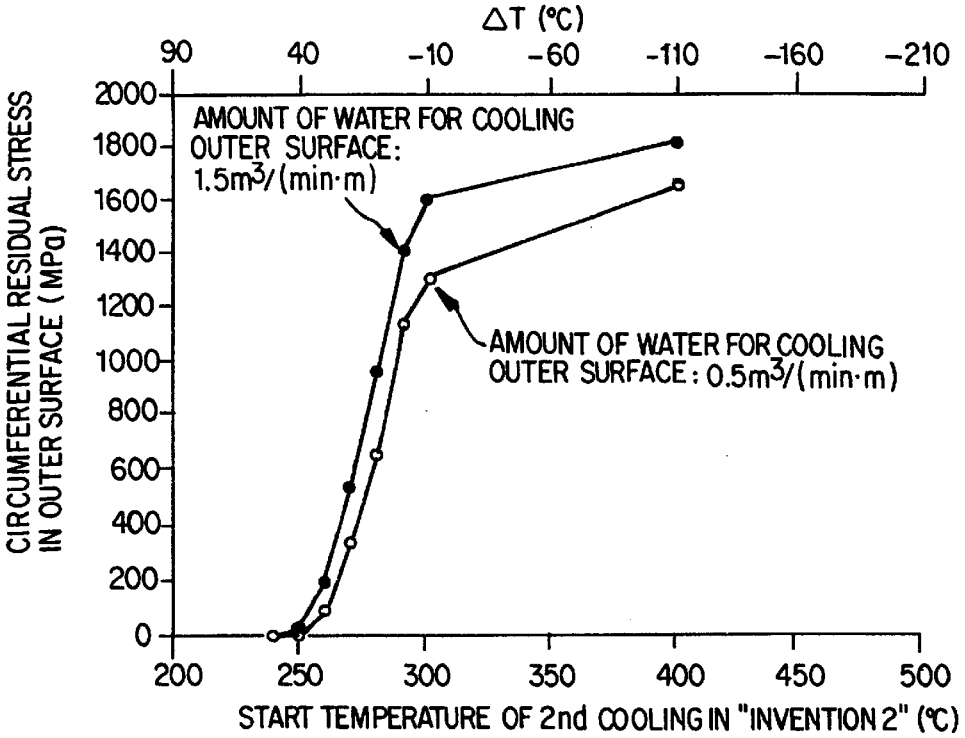

FIG. 6 is a graph illustrating the effect of the start temperature for the second cooling on the circumferential residual stress on the outer surface. Generally, if the circumferential residual stress on the outer surface is 200 MPa or less, quench cracking rarely occurs. As can be seen from the figure, the residual stress is about 200 MPa if ΔT is 30° C. and, accordingly, no quench cracking is caused if ΔT is 30° C. or higher.

For example, in the case of a martensitic stainless steel having Ms point at 290° C. and Mf point at 100° C., the central temperature is 195° C. Accordingly, when intensive cooling is started, from about 250° C., since ΔT is +40° C., high residual stress to promote the quench cracking does not occur.

In the method of invention [2], since ΔT is set as 30° C. or higher, the residual stress scarcely occurs and quench cracking does not occur. Furthermore, since cooling is transferred at a temperature 15 higher than the central temperature 12 to the second cooling (intensive cooling), the residual austenite can be suppressed and degradation of the corrosion resistance can also be prevented.

In the case of the method of invention [3], tensile plastic strain is yielded due to thermal stresses during the first cooling which is intensive cooling on the outer surface of the steel pipe. Subsequently, the intensive cooling is switched to the mild cooling or the second cooling when the outer surface temperature reaches the temperature 21 higher than the Ms point, to attain the reduction of the temperature difference in the direction of the thickness by the heat recuperation. When the outer surface temperature is intensively cooled to lower than the Ms point by the first cooling, since transformation stress occurs, no reduction can be expected for the residual stress even by subsequent heat recuperation.

The first cooling stop temperature is set in a temperature region from "Ms point+400° C." to Ms point. If the first cooling stop temperature exceeds "Ms point+400° C.", tensile plastic strain yielded at the outer surface is insufficient. On the other hand, if the stop temperature is lower than the Ms point, no reduction can be expected for the residual stress by the heat recuperation.

Since the second cooling is continuous from the first cooling, the second cooling start temperature 21 is naturally within a range from "Ms point+400° C." to Ms point. Usually, since the Ms point of the steel as the object of the present invention is from 200° C. to 300° C., the upper limit of the second cooling start temperature 21 is about 700° C. to 600° C. On the other hand, the second cooling stop temperature is set equal to the central temperature or higher. If the stop temperature for the second cooling or mild cooling is lower than the central temperature, the cooling rate at the inner surface in this temperature region determining the amount of the residual austenite is lowered, to increase the residual austenite at the inner surface.

Furthermore, by reducing the temperature difference caused during the first cooling by heat recuperation in the second cooling, the average heat transfer coefficient is set to ½ or less of that upon completion of the first cooling. If the heat transfer coefficient is greater, the heat recuperation is insufficient and the temperature difference between the inner and the outer surfaces does not fall within a desired range. Although there is no particular restriction on the lower limit of the heat transfer coefficient in the second cooling, a heat transfer coefficient capable of obtaining a higher cooling rate than that of air cooling is desirable for shortening the heat treatment time.

In the case of the method of invention [3], after yielding of the tensile plastic strain on the outer surface in the first cooling, mild cooling is applied in the second cooling and it is passed though the Ms point while keeping a certain temperature difference in the direction of the thickness. In this case, the tensile plastic strain yielded by the first cooling reduces the occurrence of the plastic strain during the second cooling. Therefore, the residual stress can be suppressed in a small value and, accordingly, the quench cracking can be suppressed although the cooling time is shortened as compared with that in invention [2]. The difference between the invention [2] and invention [3] is as described above.

In the third cooling, intensive cooling is applied again. The reason for intensively cooling the temperature region is to suppress the residual austenite as described above. The third cooling start temperature 22 is in the temperature region from the Ms point to central temperature. The upper limit temperature for the third cooling starting, that is, Ms point in invention [3] can be made higher than the upper limit temperature for the second cooling "Ms point−30° C." in the method of invention [2]. This is because the tensile plastic strain yielded in the first cooling still remains after the second cooling, and it reduces the occurrence of plastic strain caused by the transformation yielded during the third cooling.

If the cooling rate on the inner surface in the second cooling is at 8° C./s or higher, for example, due to the reason that the steel pipe has a thin thickness, it is not necessary that more intensive cooling than in the second cooling is applied in the third cooling, and cooling may be continued as it is by the same cooling means as used in the second cooling. However, for shortening the heat processing time, it is desirable that the cooling rate in the third cooling is increased to greater than that in the second cooling.

Figure 7:
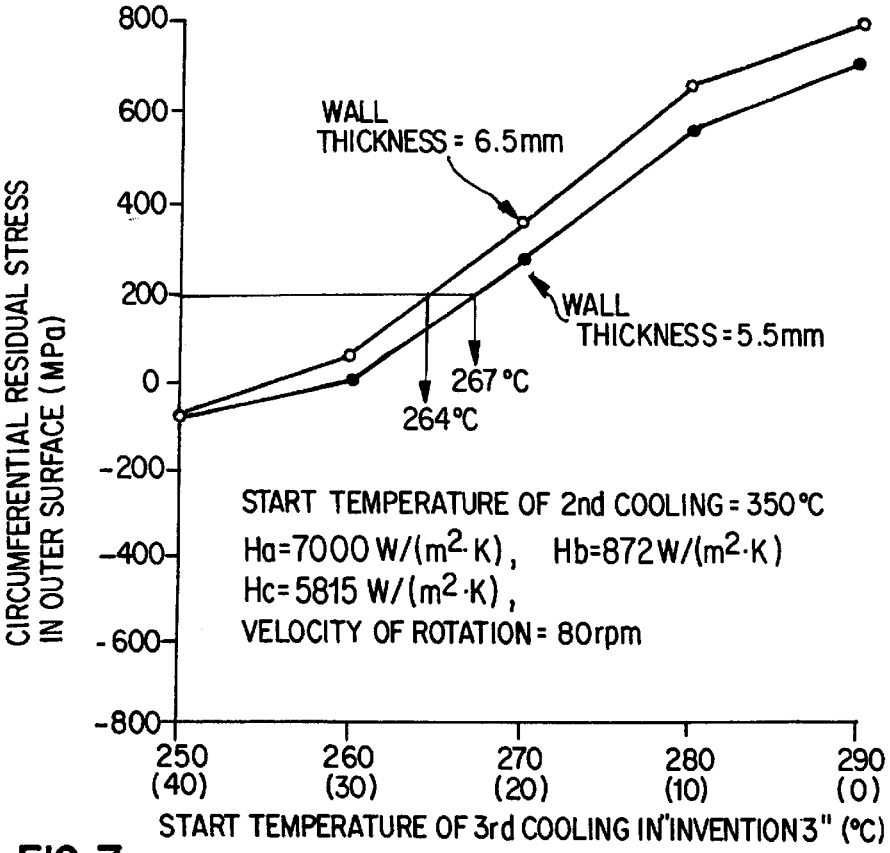

FIG. 7 is a graph illustrating the effect of the third cooling start temperature on the circumferential residual stress on the outer surface of the pipe when the method of invention [3] is applied. As shown in FIG. 7, the residual stress increases as the third cooling start temperature rises, that is, as $\Delta T$ approaches to 0, but the gradient of the increment is more moderate than the gradient of increment to the second cooling start temperature in the method of invention [2]. It can be seen that the residual stress increases with the increase of wall thickness from that shown in FIG. 7. Under the same cooling conditions, the residual stress increases substantially in proportion with the thickness.

It can be seen in FIG. 7, the residual stress may be suppressed to 200 MPa or lower which is a value sufficient to prevent the occurrence of the quench cracking by setting the third cooling start temperature 22 to 267° C. or lower in the case of 5.5 mm wall thickness, while by setting the temperature to 264° C. or lower in a case of 6.5 mm wall thickness. The upper limit for the third cooling start temperature can be selected in accordance with the average heat transfer coefficient Hb in the second cooling or the average heat transfer coefficient Hc in the third cooling.

Then, explanation will be made to the third cooling start temperatures and the method of selecting Hb and Hc in a case of the wall thickness of 5.5 mm as an example. The heat transfer coefficient Ha in the first cooling means the heat transfer coefficient in the first cooling near the first cooling stop temperature unless otherwise specified.

Figure 8:
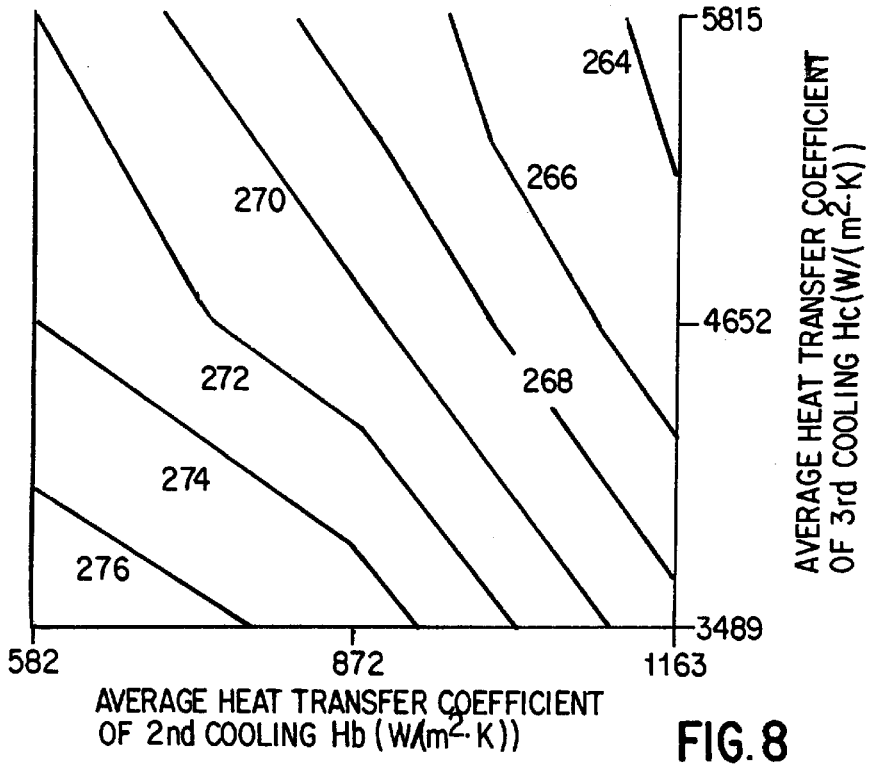

FIG. 8 is a graph illustrating the relationship between the average heat transfer coefficient Hb in the second cooling and the average heat transfer coefficient Hc in the third cooling,under which the residual stress 200 MPa is built. Each of flexed lines represent third cooling start temperature as indicated. Each of the flexed lines was calculated by finite element method assuming the second cooling start temperature as 350° C. and the heat transfer coefficient Ha in the first cooling as 7000 W/(m$^2$·K).

If Hb (abscissa) and Hc (ordinate) are determined, the third cooling start temperature at which the circumferential residual stress on the outer surface is 200 MPa can be determined. The third cooling start temperature may be formularized as a regressive equation from FIG. 8 as the following formula (a).

$$\text{"Third cooling start temperature for residual stress at 200 Mpa"}(^\circ\text{C.}) = \text{Ms}(^\circ\text{C.}) + 6.4 - 0.015\ \text{Hb}\ (\text{W}/(\text{m}^2\cdot\text{K})) - 0.00276\ \text{Hc}(\text{W}/(\text{m}^2\cdot\text{K})) \quad \text{(a)}$$

Accordingly, the third cooling start temperature can be determined based on the formula (a) above while setting Hb and Hc within a practically possible range, for example, for laminar flow water cooling. FIG. 8 or the equation (a) are the result of setting the heat transfer coefficient Ha in the first cooling at a constant value of 7000 W/(m$^2$·K). If Ha fluctuates, the allowable range for the third cooling start temperature also varies.

Figure 9:
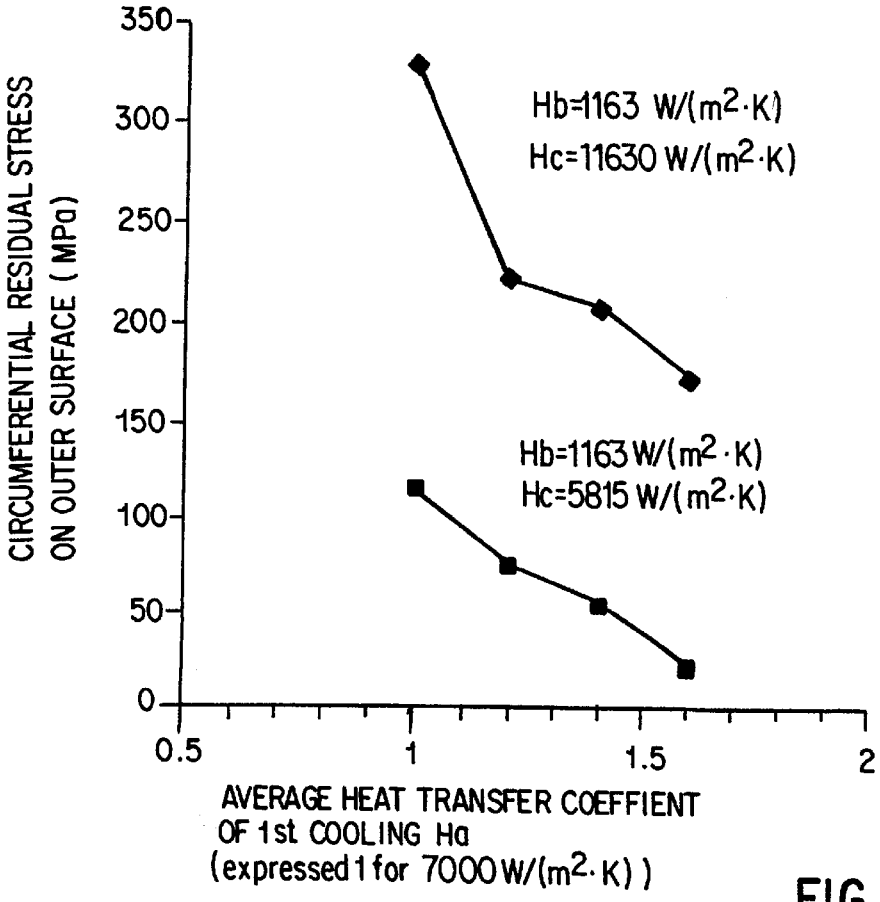
FIG. 9 is a graph showing the effect of an average heat transfer coefficient in the first cooling (indicating 7000 $W/(m^2-K)$ as 1) on the circumferential residual stress on the outer surface of the martensitic stainless steel pipe with a 5.5 mm wall thickness upon applying the method of invention [3].

FIG. 9 is a graph illustrating the effect of the heat transfer coefficient Ha in the first cooling on the circumferential residual stress on the outer surface. In the figure, 7000 W/(m$^2$·K) is indicated as 1 on the abscissa. As shown in FIG. 9, since the circumferential residual stress on the outer surface is reduced by increasing the heat transfer coefficient in the first cooling, the third cooling start temperature can be made higher than the temperature shown in FIG. 8 by increasing the heat transfer coefficient in the first cooling. However, this does not mean that a greater heat transfer coefficient Ha in the first cooling is always preferred, since this can make the third cooling start temperature higher and cooling time shorter. Considering the accuracy for switching control of cooling from the first cooling to the second cooling and the entire cooling time till the steel pipe is completely cooled down to the room temperature, a desired upper limit for Ha is determined of itself.

For shortening the entire cooling time, it is important to shorten the cooling time in the second cooling as the mild cooling stage. It is desirable that the second cooling start temperature is as close to the Ms point as possible. For example, the second cooling can be started from the temperature region from "Ms +60° C." to Ms. The heat transfer coefficient Ha upon completion of the first cooling is preferably within a range from 5000 to 10000 W/(m$^2$·K). This heat transfer coefficient Ha corresponds to a heat transfer coefficient when cooling water is supplied in an amount from 0.3 to 1.0 m$^3$/(min·m) by double slit laminar cooling.

Figure 10:
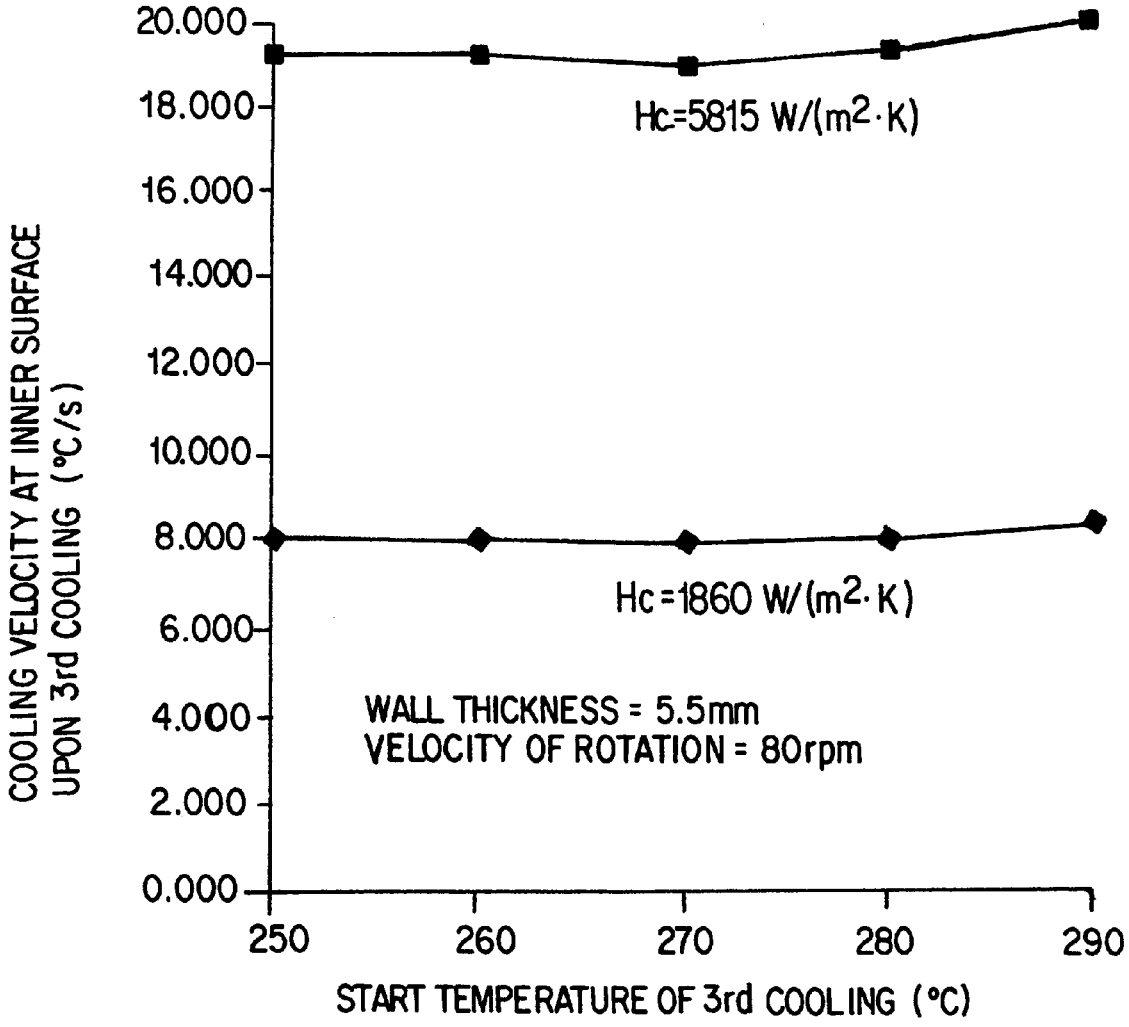
FIG. 10 is a graph illustrating the effect of the third cooling start temperature and the average heat transfer coefficient in the third cooling on the cooling rate at the inner surface of the pipe in the third cooling with 5.5 mm wall thickness upon applying the method of invention [3].

FIG. 10 is a graph illustrating the effect of the third cooling start temperature and the average heat transfer coefficient Hc in the third cooling on the cooling rate at the inner surface of the pipe during the third cooling. It can be seen from FIG. 10 that Hc is required for more than 1860 W/(m$^2$·K) in order to ensure the inner surface cooling rate in the third cooling of 8° C./s or higher in case of 5.5 mm wall thickness.

The conditions of using the Hc at a value of 1860 W/(m$^2$·K) and that the third cooling start temperature has to be lower than the Ms point provides a ground that air cooling may be conducted for cooling without using a lower spray or the like during the second cooling. Air convection and radiative cooling are present on the outer surface of the steel pipe, and the heat transfer coefficient by air cooling near the Ms point can be estimated as about 35 W/(m$^2$·K). Accordingly, when the equation (a) described above is substituted for Hb=35 W/(m$^2$·K) and Hc=1860 W/(m$^2$·K), the third cooling start temperature, providing 200 MPa of the residual stress, is substantially at the Ms point.

Since the residual stress is in proportion with the wall thickness, if the wall thickness is thinner than 5.5 mm, the upper limit for the third cooling start temperature for suppressing the residual stress to lower than 200 MPa can be set slightly higher than the Ms point if the wall thickness is less than 5.5 mm. However, the wall thickness of 5 mm is the minimum thickness at present for the high strength oil countries tubular goods and it is desirable to Furthermore lower the residual stress in the feature if the wall thickness is reduced Furthermore, so that the third cooling start temperature is set to the Ms point or lower.

4. Heating Before Cooling

The heating temperature before cooling is desirably set to such a temperature as not to make the austenite grains coarser, for example, at a temperature lower than 1100° C. irrespective of the material of the steel pipe, for example, carbon steel, low alloy steel or martensitic stainless steel. Furthermore, in the case of the martensitic stainless steel, the temperature is preferably selected to such a temperature region that the ratio of δ ferrite does not reach 20%, for example, from 900° C. to 1100° C. The cooling start temperature is usually a temperature identical with the heating temperature before cooling, or a temperature subtracting a temperature fall (by less than 50° C.) from the heating apparatus to the cooling apparatus.

Irrespective of the material for the steel pipe, quenching may be applied by so-called direct quenching by utilizing heat possessed in the material after hot deformation or auxiliary heating in the line and then cooling as it is, not only reheating and cooling in the so-called off line. The cooled steel pipe is applied with tempering.

In the case of the martensitic stainless steel pipe, tempering is applied in a temperature region from 593° C. to $Ac_1$ point according to the stipulations of API L 80 to provide desired characteristics depending on the application uses. For providing satisfactory corrosion resistance, the tempering temperature is desirably higher than 650° C. Cooling after the tempering is desirably conducted at a cooling rate higher than that for the air cooling and the toughness is increased as the cooling rate is higher. However, the upper limit for the tempering temperature is set to the $Ac_1$ point or lower.

Furthermore, even if treatment for correction by a hot straightener is applied after the tempering, there is no problem in the characteristics.

5. Material Property for the Martensitic Stainless Steel Pipe

The desirable manufacturing conditions other than the cooling method for the martensitic stainless steel pipe is shown below. "%" attached to the alloying elements means "% by weight".

(1) Chemical Composition

Among alloying elements for the martensitic stainless steel pipe both having wet corrosion resistance for carbon dioxide and corrosion resistance to sulfide stress corrosion cracking, C and Cr are desirable in the following region. Other alloying elements and contents may be optional so long as more than 80% of martensite is contained and it does not particularly decrease the wet corrosion resistance to carbon dioxide and corrosion resistance to sulfide stress corrosion cracking.

C: 0.1–0.3%

If C is less than 0.1%, a great amount of δ ferrite is formed thereby failing to obtain a desired strength and corrosion resistance. On the other hand, if C exceeds 0.3%, the remaining austenite is inevitable to deteriorate the corrosion resistance even if cooling is conducted by the method according to the present invention, as well as quench cracking can not be inhibited even if the method of the present invention is applied. Accordingly, it is desirably from 0.1 to 0.3.

Cr: 11–15%

If Cr is less than 11%, the corrosion resistance deteriorates. On the other hand, if it exceeds 15%, δ ferrite is formed, failing to obtain a desired microstructure and both the strength and the corrosion resistance are decreased, so that it is desirably from 11 to 15%.

(2) Microstructure

For providing both desired strength and corrosion resistance, it is desirable that the microstructure of the martensitic stainless steel pipe comprises 80% or more of martensite. If the martensite is less than 80%, no desired yield stress can be obtained. The ratio (%) in the microstructure means herein an area ratio in the view field of an optical microscope. The microstructure may entirely comprise martensite (100% martensite), while less than 20% of/other phases may also be present. In the method according to the present invention, the residual austenite is suppressed as described above and, accordingly, "phases other than the martensite" means a large portion of δ ferrite and a small amount of residual austenite phase increasing along with increase of C content.

In order that the microstructure of the martensitic stainless steel comprises more than 80% of martensite, it is desirable that alloying elements other than C and Cr are contained in the following range. For example, it may be a steel comprised of Si: 0.01–1%, Mn: 0.01–1%,m Mo: 0–3%, Ni: 0–5%, sol Al: 0.001–0.1%, N:0–0.1%, Nb: 0–0.5%, Ti: 0–0.5%, V: 0–0.8%, Cu: 0–2%, Ca: 0–0.01%, Mg: 0–0.01% and B: 0–0.01%, and less than 0.1% of P and less than 0.05% of S as impurities.

The effect of the present invention will be explained by way of a preliminary test and several examples.

Preliminary Test

A cooling test for an ordinary steel pipe was conducted by using a cooling apparatus shown in FIG. 2. The cooling test was conducted by heating a steel pipe in a heating furnace at 900° C., and then while rotating and cooling from 850° C.,the outer surface by double slit laminar water and passing water into the pipe for the inner surface, measuring the temperature change of the steel pipe.

Figure 11:
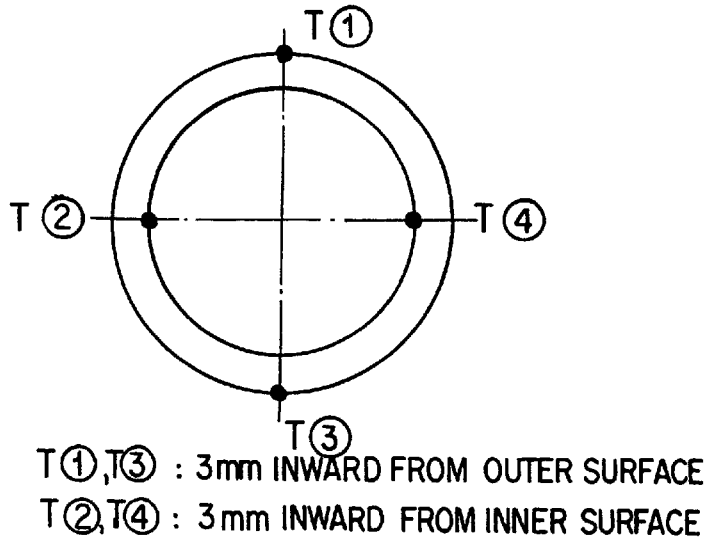
FIG. 11 is a view illustrating the positions for measuring the temperature at the inner and the outer surfaces of the steel pipe in Examples 1 and 2. The cooling progress at the central portion of the thickness can be forecast with an extremely high accuracy by a calculation based on the actually measured cooling curves at the inner and the outer surfaces.

FIG. 11 is a view illustrating a temperature measuring position of the inner and outer surfaces of a steel pipe attached with a thermocouples. Cooling curves at the positions were measured while changing the cooling conditions such as flow rate of water supplied to the inner and the outer surfaces.

The steel pipe used was an ordinary steel pipe of 139.7 mm diameter, 16.0 mm of wall thickness and 1100 mm of length (chemical composition, C:0.01%, Si: 0.4% and Mn: 1.0%). It was set such that the slit interval between the dual slit laminar flows was 100 mm, and the height of the nozzle for supplying cooling water to the outer surface was 1245 mm from the top end of the steel pipe. The rotational speed of the steel pipe was set to 60 rpm. Water temperature for the cooling water was about 36° C. Cooling by passing water on the inner surfaces was conducted under the condition of, suppressing the amount of water and not completely filling the inside of the steel pipe with cooling water.

Table 1 is a graph illustrating the result of measurements for the cooling rate. The cooling rate was read from the cooling curve. In the case of the test materials f, g in which the cooling velocity was slowest, it was confirmed by the numerical calculation that the cooling rate at the central portion of the wall thickness was 21° C./s. Each of the cooling rates at the center of the thickness for other test materials was above 21° C./s.

TABLE 1

| Test Material | Amount of water ($m^3$/h) Inner surface | Outer Surface | Temp. of cooling water (° C.) | Cooling Velocity (° C./s) Film boiling | Nucleate boiling |
|---|---|---|---|---|---|
| a | 35 | 26 | 36 | 15 | 47* |
| b | 35 | 26 | 36 | 18 | 44* |
| c | 25 | 26 | 36 | 19 | 35 |
| d | 25 | 26 | 36 | 23 | 30 |
| e | 25 | 26 | 37 | 21 | 31 |
| f | 15 | 26 | 37 | 19 | 27 |
| g | 15 | 26 | 37 | 20 | 31 |
| h | 25 | 39 | 37 | 21 | 32 |
| i | 25 | 39 | 37 | 22 | 35 |
| j | 25 | 39 | 37 | 24 | 31 |

Numerical value attached with mark * is out of the limit determined as "invention 1".

Figure 12:
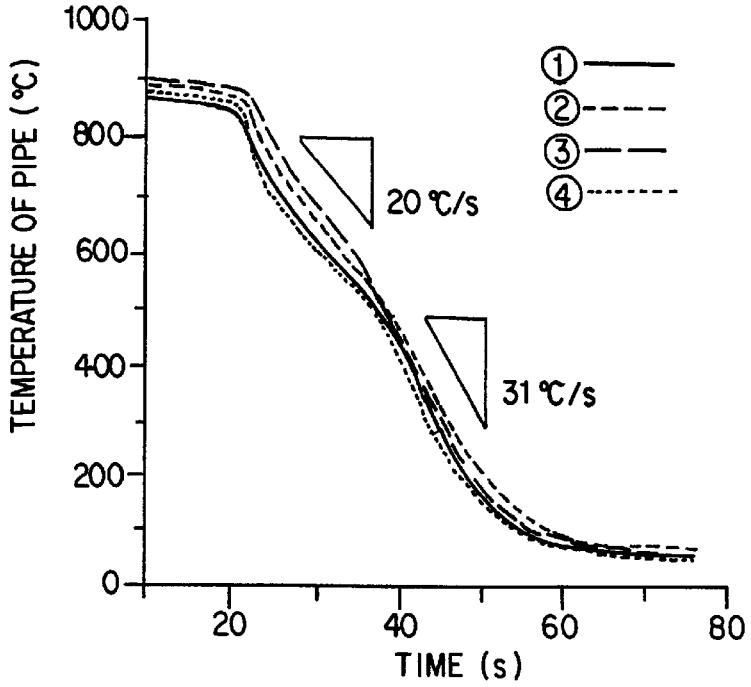
FIG. 12 is a graph illustrating a cooling curve in the preliminary test.

FIG. 12 is a graph showing an example of the cooling curve (test material g in Table 1). As illustrated in FIG. 12, the cooling rate upon film boiling was determined from the temperature gradient for a linear portion in a high temperature region in the former half of cooling, while the cooling rate upon nucleate boiling was determined from the temperature gradient for a linear portion in a low temperature region in the latter half of cooling.

As described above, the cooling rate during nucleate boiling is higher than the cooling rate during film boiling and it is important to suppress the cooling rate upon nucleate boiling in order to make the cooling rate equal between the inner surface and the outer surface.

Figure 13:
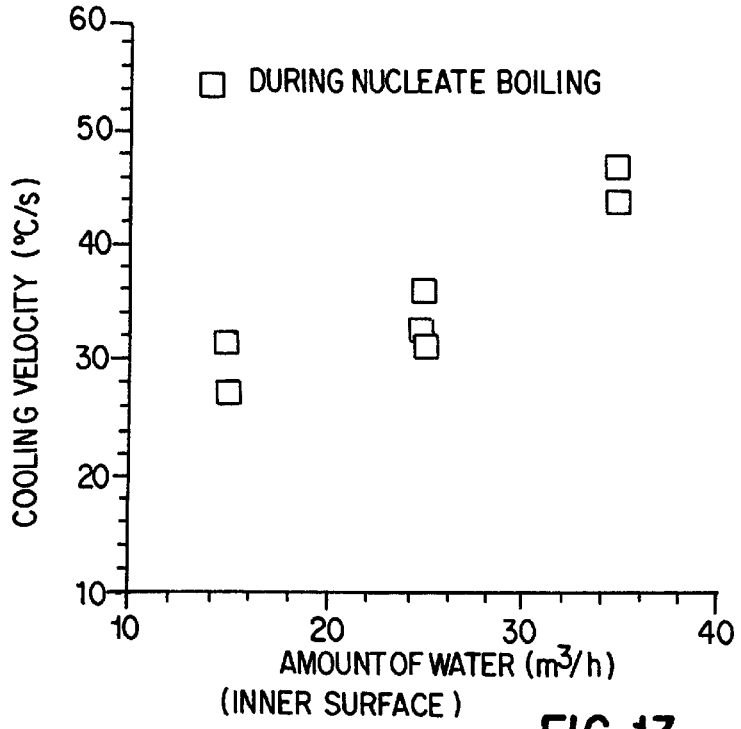
FIG. 13 is a graph illustrating the dependence of cooling rate on the flow rate of water on the inner surface of the steel pipe of invention [1].
Figure 14A:
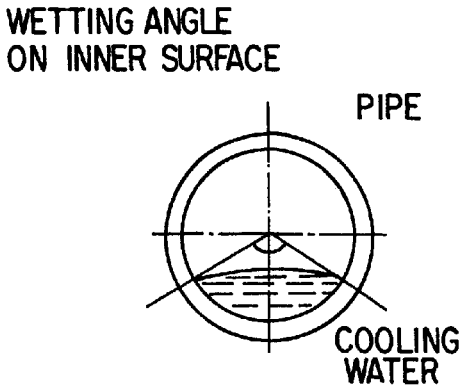
Figure 14B:
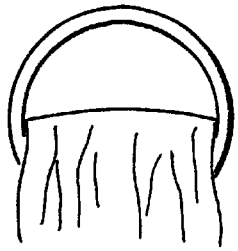
Figure 14C:
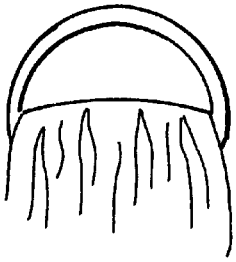
Figure 14D:
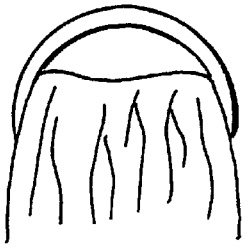

FIG. 13 is a graph showing the dependence of the cooling rate on the amount of water at the inside of the pipe during nucleate boiling when the amount of water on the outer surface was set to a constant value of 26 $m^3$/h. It can be seen that the cooling rate can be decreased by decreasing the amount of water at the inner surface.

FIG. 14A to FIG. 14D are views of illustrating the flow of the coolant. The wetting angle on the inner surface was 160° at the flow rate of water on the inner surface of 15 $m^3$/h. The wetting angle at the inner surface was 180° at the flow rate of water on the inner surface of 25 $m^3$/h, and the wetting angle at the inner surface was 220° at the flow rate of water on the inner surface of 35 $m^3$/h.

Cooling for making the difference of the cooling rate lesser between the inner and the outer surfaces can be attained by flowing coolant into the steel pipe so as to reduce the wetting angle on the inner surface while rotating the steel pipe around the axis of the pipe.

It can be seen from the cooling curve in FIG. 12 and FIG. 15 that the cooling is done while suppressing the temperature difference between the inner and the outer surfaces.

Example 1

A cooling test for 13% Cr-containing martensitic stainless steel pipe was conducted by using a cooling apparatus shown in FIG. 2. The cooling test was conducted by heating a steel pipe in a heating furnace at 1000° C., and then flowing down double slit laminar water on the outer surface and passing water into the inner surface from 900° C., while rotating the pipe and measuring the temperature change of the steel pipe.

The steel pipe used is a 13%-Cr-containing martensitic stainless steel pipe (C:0.18%, Si:0.20%, Mn:0.70%, Cr:12.9%, and substantial balance of Fe), having a diameter of 139.7 mm, wall thickness of 16.0 mm and length of 1200 mm. The Ms point is 290° C. The amount of cooling water supplied to the inner surface was 15 $m^3$/h, while the amount of cooling water on the outer surface was set to 26 $m^3$/h. The wetting angle on the inner surface was 160°. The slit gap of the double slit laminar flows was 100 mm, the height of the nozzle for supplying outer surface cooling water was 1245 mm from the top end of the steel pipe. The rotational speed of the steel pipe was set to 60 rpm. The temperature of the coolant was about 36° C. The temperature was measured by thermocouple at positions shown in FIG. 11 like that in the preliminary test.

For comparison, a cooling test was conducted using a conventional method in which the amount of cooling water on the outer surface was set to 26 $m^3$/h, while the amount of water on the inner surface was set to 250 $m^3$/h (an amount that completely filled the inside of the pipe with cooling water).

FIG. 15 is a graph illustrating cooling curves. Curve A shows the result of the-example by the present invention, while the curve B is a result by the conventional method. While the maximum cooling rate of the curve A was 31° C./s, the maximum cooling rate on the inner surface of the curve B was 60° C./s. The cooling curve A shows the result of applying the method according to the present invention in which a preferred cooling rate is attained. Furthermore, the temperature difference between the inner and the outer surfaces of the steel pipe is about 60° C. at maximum and it can be seen that cooling was made uniformly as compared with the curve B.

As a result of the numerical calculation, based on the result of this measurement or the like, the cooling rate at the central portion of the wall thickness in the curve A was confirmed to be 26° C./s or higher.

Identical cooling was applied to each of ten steel pipes by using the method according to the present invention and the conventional method. As a result, while three quenching cracks were formed in the conventional example, no quench cracking was evident in the method according to the present invention.

Example 2

Table 2 shows a chemical composition of the test steel pipe used for the example. The steel has the Ms point at 290° C. and the Mf point at 100° C. Accordingly, "Ms point+400° C." is 690° C., "Ms point −30° C." is 260° C. and the central temperature,that is, (Ms point+Mf point)/2 is 195° C. The martensitic stainless steel for the chemical composition shown in the figure was prepared by melting, to manufacture a martensitic stainless steel pipe having a 151 mm outer diameter, 5.5 mm wall thickness and a 15 m length by usual Mannesman pipe manufacturing process.

TABLE 2

| Chemical composition (wt %) The others: Fe + impurities | | | | | | | | | | | Ms point | Mf point |
|---|---|---|---|---|---|---|---|---|---|---|---|---|
| C | Si | Mn | P | S | Cr | Ni | Mo | V | sol.A1 | N | (° C.) | (° C.) |
| 0.2 | 0.31 | 0.39 | 0.02 | 0.001 | 13.1 | 0.03 | 0.03 | 0.08 | 0.032 | 0.04 | 290 | 100 |

Table 3 shows cooling conditions for cooling the steel pipe. After cutting out test steel pipes each of 1 m length from the steel pipe described above and heating at 980° C., cooling was applied for every 100 test pipes under each of cooling conditions. In Table 3, the thermal transfer coefficient Ha in the first cooling of test No. 1–test No. 3 (example of invention [2]) is the heat transfer coefficient upon air cooling, and is about 35 W/(m$^2$·K) at a rotational speed of 40 to 80 rpm .

invention [2] and for the first cooling and the third cooling in the method of invention [3], the laminar flow 3 is used but the lower spray is not used. Switching between the first cooling and the second cooling was attained by interrupting the laminar flow cooling by the shutter 7 disposed above the pipe and, at the same time, by setting up the lower spray, while the switching between the second cooling and the third cooling was achieved by the opposite procedures.

TABLE 3

| | No. | Cooling pattern | Ha (W/m$^2$K) | Hb (W/m$^2$K) | $T_Q$ (° C.) | Cooling velocity (° C./s) | Cooling period (s) | Marten-site ratio (%) | No. of quench crack |
|---|---|---|---|---|---|---|---|---|---|
| I | 1 | AC-IC | 35 | 5000 | 260 | 22.8 | 1250 | 100 | 0 |
| | 2 | AC-IC | 35 | 10000 | 250 | 32.1 | 1330 | 100 | 0 |
| | 3 | AC-IC | 35 | 15000 | 200 | 39.7 | 1760 | 100 | 0 |
| | 4 | IC-MC-IC | 7000 | 582 | 260 | 18.8 | 46.6 | 100 | 0 |
| | 5 | IC-MC-IC | 7000 | 872 | 260 | 19.2 | 35.3 | 100 | 0 |
| | 6 | IC-MC-IC | 7000 | 1163 | 260 | 19.3 | 29.8 | 100 | 0 |
| | 7 | IC-MC-IC | 10000 | 582 | 260 | 18.8 | 48.2 | 100 | 0 |
| | 8 | IC-MC-IC | 10000 | 1163 | 260 | 19.3 | 31.1 | 100 | 0 |
| | 9 | IC-MC-IC | 7000 | 582 | 270 | 18.9 | 43.1 | 100 | 0 |
| | 10 | IC-MC-IC | 7000 | 582 | 280 | 18.5 | 40.3 | 100 | 0 |
| | 11 | IC-MC-IC | 7000 | 872 | 290 | 8.2 | 42.8 | 100 | 0 |
| | 12 | IC-MC-IC | 5000 | 582 | 280 | 10.8 | 51.6 | 100 | 0 |
| | 13 | IC-MC-IC | 5000 | 35 | 290 | 8.2 | 75.1 | 100 | 0 |
| II | 14 | IC | — | — | — | 42 | 10.8 | 100 | 56 |
| | 15 | MC | — | — | — | 7.5 | 86.5 | 96 | 2 |
| III | 16 | AC | — | — | — | 0.2 | 4000 | 91 | 0 |
| | 17 | EAC | — | — | — | 2.3 | 360 | 93 | 0 |
| | 18 | OQ | — | — | — | 4.1 | 190 | 96 | 0 |

Note:
1) Class I is composed of examples of "invention 2" and "invention 3". Class II is comparison examples, and Class III is conventional examples.
2) MC means mild cooling, IC is intensive cooling, AC is air cooling, EAC is enforced air cooling and OQ is oil quench.
3) AC-IC is the method of "invention 2", IC-MC-IC is the "invention 3". IC of test No. 14 is the cooling with a constant amount of slit laminar water 0.5 m$^3$/min from start to end. MC of test No. 15 is the cooling with lower spray nozzle from start to end.
4) Ha is average heat transfer coefficient at the end of 1st cooling of "invention 2" and "invention 3".
5) Hb is average heat transfer coefficient of 2nd cooling of "invention 2" and "invention 3".
6) $T_Q$ means, in case of invention 2 (No. 1–3), the outer temperature upon start to 2nd cooling, whereas in case of invention 3 (No. 4–13) that of 3rd cooling.
7) Cooling velocity is the average cooling velocity of 2nd cooling in invention 2, and that of 3rd cooling in invention 3.
8) Cooling period is the interval from start of cooling to the time outer temperature of pipe reaches 100° C.

The cooling was conducted, as shown in FIG. 1B, by using a laminar flow cooling apparatus while rotating the steel pipe by the rotational roll 4 at a speed of 40 rpm and supplying water with a flow rate of 0.5m$^3$/min per 1 m of the steel pipe by the slit laminar nozzle 3. The average heat transfer coefficient on the outer surface with the amount of water was about 9,000 W/(m$^2$·K) at the outer surface temperature of 300° C., about 7000 W/(m$^2$·K) at 350° C. and about 5800 W/(m$^2$·K) at 400° C.

The cooling water 6 from the lower spray nozzle is used for practicing the second cooling in the cooling method of invention [3]. For the second cooling in the method of Furthermore, in the cooling test previously conducted for the steel pipe, the temperature on the inner surface during cooling was measured by attaching thermocouples on the inner surface. The temperature on the outer surface of the pipe and the cooling rate on the inner surface were forecast under the individual cooling conditions by the numerical analysis method which was confirmed to have a sufficient accuracy referring to the result of the measurement.

In the case of conducting intensive cooling during the first cooling as in the method of invention [3], the change time from the first cooling to the second cooling (mild cooling) was determined as the timing at which the outer surface temperature reaches 350° C., and the change time was determined based on the forecast temperature change on the outer surface.

Furthermore, switching between the second cooling and the third cooling (intensive cooling) was conducted in the same manner by forecasting the outer surface temperature and each experiment was carried out while ΔT was varied. Furthermore, it was confirmed for the cooling rate that the forecast cooling rate is appropriate by measuring the cooling rate at the inner surface. The cooling rate described in Table 3 is a measured value, which is an average value in the temperature region of the third cooling. In this example, the cooling rate on the inner surface was at 8° C./s or more as in invention [2] and invention [3].

After cooling, the steel pipe was checked visually for the absence or the presence of quench cracking. Subsequently, tempering was applied at 730° C. to investigate the stress and the corrosion resistance. The number of the test specimens that cause quench cracking is shown in Table 3. It shows the number of specimens that caused quench cracking in 100 test steel pipes on every cooling condition.

The corrosion resistance was investigated by four-point bending test with a notch capable of simultaneously evaluating the wet corrosion resistance to carbon dioxide and corrosion resistance to sulfide stress corrosion cracking.

FIG. 16(*a*) shows a four-point bending test piece with a notch and (*b*) shows a state of the four-point bending test piece with a notch mounted to a jig for loading the bending deformation. For the bending deformation, a bolt in a jig is enforced to yield bending stress so that a stress in the central position of the 4-point bending test piece reaches 100% of the nominal yield strength for the martensitic stainless steel. A test piece mounted to the jig and loaded was dipped in an aqueous 5% sodium chloride solution at 25° C. saturated with 30 atm of carbon dioxide and 0.05 atm of hydrogen sulfide which were finally investigated for the absence or the presence of cracking.

Table 4 shows the result of a tensile test and a four-point bending test with notch. In Table 4 since cooling was conducted for test No. 1–test No. 13 as the example of the application of the present invention at a cooling rate on the inner surface to 8° C./s or higher in a temperature region, from the central temperature to the Mf point, no quench cracking resulted, the yield ratio was high and corrosion resistance was also satisfactory.

TABLE 4

| No. | Yield stress (kgf/mm$^2$) | Tensile stress (kgf/mm$^2$) | Yield ratio (%) | Corrosion test result |
|---|---|---|---|---|
| I | | | | |
| 1 | 66.1 | 76.8 | 86.1 | ○○○○○ |
| 2 | 65.6 | 74.6 | 87.9 | ○○○○○ |
| 3 | 65.6 | 75.2 | 87.2 | ○○○○○ |
| 4 | 67.6 | 74.8 | 90.4 | ○○○○○ |
| 5 | 66.8 | 74.9 | 89.2 | ○○○○○ |
| 6 | 66.1 | 75.2 | 87.9 | ○○○○○ |
| 7 | 65.6 | 74.4 | 88.2 | ○○○○○ |
| 8 | 67.7 | 75.8 | 89.3 | ○○○○○ |
| 9 | 67.4 | 75.7 | 89.0 | ○○○○○ |
| 10 | 65.8 | 75.0 | 87.7 | ○○○○○ |
| 11 | 67.4 | 75.3 | 89.5 | ○○○○○ |
| 12 | 65.8 | 75.0 | 87.7 | ○○○○○ |
| 13 | 65.2 | 75.1 | 86.7 | ○○○○○ |
| II | | | | |
| 14 | 67.2 | 75.9 | 86.5 | XX○○○ |

TABLE 4-continued

| No. | Yield stress (kgf/mm$^2$) | Tensile stress (kgf/mm$^2$) | Yield ratio (%) | Corrosion test result |
|---|---|---|---|---|
| 15 | 60.5 | 74.0 | 81.8 | XXXX○ |
| III | | | | |
| 16 | 61.3 | 81.7 | 75.0 | XXXXX |
| 17 | 59.0 | 80.1 | 73.7 | XXXXX |
| 18 | 59.3 | 75.0 | 79.1 | XXXX○ |

Note:
1) Class I is composed of examples of "invention 2" and "invention 3", Class II is comparison examples, and Class III is conventional examples.
2) ○: no break, X: break On the other hand, in the case of test No. 14 and No. 15 as the example of the application of the comparative method, where cooling was conducted while supplying a constant amount of water during cooling, quench cracking was caused. Furthermore, in the cooling method where the cooling rate was lower than 8° C./s as in test No. 15, the yield ratio was low and the corrosion resistance was poor. In this case, quench cracking was also caused.

In the example of the application of the conventional method, test No. 16 and test No. 17, the quench cracking was not caused but the yield ratio was low and the corrosion resistance was poor. On the other hand, in the example, test No. 18,in which oil quenching,dipping in the oil, is applied, quench cracking did not occur but the yield ratio was poor since the cooling rate was lower than 8° C./s to also cause poor corrosion resistance.

Industrial Applicability

The method according to the present invention, high strength martensitic stainless steel pipe having excellent corrosion resistance with no high content of expensive alloying elements can be manufactured at high productivity without causing quench cracking. Accordingly, it is possible to provide a useful material at a reduced cost for the crude oil and natural gas industry.

What is claimed is:

1. A method of cooling a steel pipe, while rotating the pipe around the axis of the pipe, wherein cooling water is made to flow down or sprayed to the outer surface of a martensitic stainless steel pipe, cooling water is passed through the inside of the pipe with a wetting angle no more than 220°, the cooling rate at the inner surface is made substantially equal to that at the outer surface, the maximum cooling rate at the inner and the outer surfaces of the steel pipe is set to 35° C./s or lower, and the cooling rate is set to 8° C./s or higher in a temperature region from the central temperature between Ms point and Mf point to the Mf point at the portion at which the cooling rate is minimum thereby cooling the martensitic stainless steel pipe.

2. A method of cooling a steel pipe as defined in claim 1, wherein the martensitic stainless steel pipe has a Ms of 200 to 300° C. and a Mf of room temperature to 150° C.

3. A method of cooling a steel pipe as defined in claim 1, wherein the martensitic stainless steel pipe includes 0.1 to 0.3% C, 11 to 15% Cr, 0.01 to 1% Si, 0.01 to 1% Mn, 0 to 3% Mo, 0 to 5% Ni, 0.001 to 0.1% sol. Al, 0 to 0.1% N, 0 to 0.5% Nb, 0 to 0.5% Ti, 0 to 0.8% V, 0 to 2% Cu, 0 to 0.01% Ca, 0 to 0.01% Mg, 0 to 0.01% B, less than 0.1% P, less than 0.1% S, balance Fe and impurities.

4. A method of cooling a steel pipe as defined in claim 1, wherein the cooling provides the steel pipe with a microstructure which includes at least 80% martensite.

5. A method cooling a martensitic stainless steel pipe comprising first cooling by applying air cooling till the temperature at the outer surface of a steel pipe reaches a temperature region from Ms point −30° C. to a central temperature between Ms point and Mf point, and second cooling by successively cooling intensively the outer surface till the temperature at the outer surface reaches a temperature region lower than the Mf point under the condition that the cooling rate at the inner surface is at 8° C./s or higher, while rotating the steel pipe around the axis of the pipe.

6. A method of cooling a steel pipe as defined in claim 5, wherein the martensitic stainless steel pipe has a Ms of 200 to 300° C. and a Mf of room temperature to 150° C. and the inner surface is cooled by air cooling.

7. A method of cooling a steel pipe as defined in claim 5, wherein the martensitic stainless steel pipe includes 0.1 to 0.3% C, 11 to 15% Cr, 0.01 to 1% Si, 0.01 to 1% Mn, 0 to 3% Mo, 0 to 5% Ni, 0.001 to 0.1% sol. Al, 0 to 0.1% N, 0 to 0.5% Nb, 0 to 0.5% Ti, 0 to 0.8% V, 0 to 2% Cu, 0 to 0.01% Ca, 0 to 0.01% Mg, 0 to 0.01% B, less than 0.1% P, less than 0.1% S, balance Fe and impurities.

8. A method of cooling a steel pipe as defined in claim 5, wherein the cooling provides the steel pipe with a microstructure which includes at least 80% martensite.

9. A method of cooling a steel pipe as defined in claim 5, wherein the cooling provides the steel pipe with a circumferential residual stress on the outer surface of 200 MPa or less.

10. A method of cooling a martensitic stainless steel pipe comprising first cooling by intensively cooling the outer surface till the temperature at the outer surface of the steel pipe reaches a temperature region from Ms point+400° C. to Ms point, second cooling of the outer surface with an average heat transfer coefficient on the outer surface of less than ½ of that upon completion of the first cooling till the temperature at the outer surface reaches a temperature region from Ms point to a central temperature between Ms point and Mf point, and third cooling by successively cooling the outer surface intensively till the outer surface temperature is lowered to less than Mf point under the condition that the cooling rate at the inner surface is 8° C./s or higher, while rotating the steel pipe around the axis of the pipe.

11. A method of cooling a steel pipe as defined in claim 10, wherein the martensitic stainless steel pipe has a Ms of 200 to 300° C. and a Mf of room temperature to 150° C. and the inner surface is cooled by air cooling.

12. A method of cooling a steel pipe as defined in claim 10, wherein the martensitic stainless steel pipe includes 0.1 to 0.3% C, 11 to 15% Cr, 0.01 to 1% Si, 0.01 to 1% Mn, 0 to 3% Mo, 0 to 5% Ni, 0.001 to 0.1% sol. Al, 0 to 0.1% N, 0 to 0.5% Nb, 0 to 0.5% Ti, 0 to 0.8% V, 0 to 2% Cu, 0 to 0.01% Ca, 0 to 0.01% Mg, 0 to 0.01% B, less than 0.1% P, less than 0.1% S, balance Fe and impurities.

13. A method of cooling a steel pipe as defined in claim 10, wherein the cooling provides the steel pipe with a microstructure which includes at least 80% martensite.

14. A method of cooling a steel pipe as defined in claim 10, wherein the cooling provides the steel pipe with a circumferential residual stress on the outer surface of 200 MPa or less.

* * * * *